US006337007B1

(12) United States Patent
Osaka

(10) Patent No.: US 6,337,007 B1
(45) Date of Patent: Jan. 8, 2002

(54) METHOD OF MAKING A CO-FE-NI SOFT MAGNETIC THIN FILM

(75) Inventor: Tetsuya Osaka, Tokyo (JP)

(73) Assignees: Waseda University; Japan Society for the Promotion of Science, both of Toyko (JP)

( * ) Notice: Subject to any disclaimer, the term of this patent is extended or adjusted under 35 U.S.C. 154(b) by 0 days.

(21) Appl. No.: 09/488,041

(22) Filed: Jan. 19, 2000

(30) Foreign Application Priority Data

Jan. 19, 1999 (JP) ..... 11-010413
Jul. 19, 1999 (JP) ..... 11-204023

(51) Int. Cl.[7] ..... C25D 3/56

(52) U.S. Cl. ..... 205/255; 205/259; 148/425; 420/440; 420/580

(58) Field of Search ..... 420/440, 580; 148/425; 205/255, 259

(56) References Cited

U.S. PATENT DOCUMENTS 4,036,709 A * 7/1977 Harbulak ..... 205/259
4,208,254 A * 6/1980 Mitsumoto et al. ..... 205/101
4,486,274 A * 12/1984 Abys et al. ..... 205/242

FOREIGN PATENT DOCUMENTS

| | | |
|---|---|---|
| JP | A5263170 | 10/1993 |
| JP | A8241503 | 9/1996 |
| JP | A8321010 | 12/1996 |
| JP | B12821456 | 8/1998 |

* cited by examiner

*Primary Examiner*—Kathryn Gorgos
*Assistant Examiner*—Wesley A. Nicolas
(74) *Attorney, Agent, or Firm*—Birch, Stewart, Kolasch & Birch, LLP

(57) ABSTRACT

A soft magnetic thin film in the form of a Co—Fe—Ni—C thin film consisting essentially of 40–70% by weight of cobalt, 20–40% by weight of iron, 5–20% by weight of nickel, and 0.02–0.1% by weight of carbon has a high saturation magnetic flux density, excellent soft magnetic properties, and a high electric resistivity.

10 Claims, 5 Drawing Sheets

METHOD OF MAKING A CO-FE-NI SOFT MAGNETIC THIN FILM

This invention relates to a soft magnetic thin film suitable for use as a pole material for combined magnetic heads in magnetic storage units, and a method for preparing the same.

BACKGROUND OF THE INVENTION

In order to accomplish high-density magnetic recording, magnetic heads built in magnetic storage units are required to generate a strong, steep and rapidly varying magnetic field for writing. In modern magnetic disk units, combined thin-film magnetic heads having incorporated together a magnetoresistive element for reading and an inductive head element for writing are predominant because the respective elements can be optimized for reading and writing purposes.

To enhance the writing magnetic field, the magnetic layers of the inductive head element must be made of a magnetic material having a high saturation magnetic flux density. The magnetic material must be readily excited by conducting electric current across a writing coil. To this end, the magnetic material must have a low coercive force and a high permeability, that is, a satisfactory soft magnetic material is needed.

Electroplated Permalloy film (nickel content 82%) which has been used as the magnetic core of thin film heads has an electric resistivity of about $20\times10^{-6}$ Ω-cm. Even when the film is made as thin as about 3 μm, the writing ability rapidly declines at a frequency in excess of 100 MHz because the magnetization change of the film cannot follow the frequency due to the very large influence of eddy current. To restrain the eddy current, the magnetic material must have a higher electric resistivity.

Permalloy mentioned above has a saturation magnetic flux density of about 0.9 to 1.0 tesla (T). If a satisfactory soft magnetic material having a higher saturation magnetic flux density is available, a magnetic head capable of generating a more strong, sharply graded writing magnetic field can be produced.

For magnetic head use, there have been proposed a number of soft magnetic materials having a higher saturation magnetic flux density than Permalloy. In particular, cobalt-iron-nickel ternary alloy films have a low coercivity, low magnetostriction constant, and high saturation magnetic flux density, and studies have been made on the composition and preparation thereof.

For example, JP-A 5-263170 discloses an electroplated cobalt-iron-nickel film consisting essentially of 60 to 90% by weight of cobalt, 3 to 9% by weight of iron, and 5 to 15% by weight of nickel. JP-A 8-241503 discloses an electroplated cobalt-iron-nickel film consisting essentially of 60 to 80% by weight of cobalt, 8 to 25% by weight of iron, and 15 to 25% by weight of nickel. JP-A 8-321010 discloses an electroplated cobalt-iron-nickel film consisting essentially of 60 to 75% by weight of cobalt, 3 to 9% by weight of iron, and 17 to 25% by weight of nickel. Japanese Patent No. 2,821,456 discloses an electroplated cobalt-iron-nickel film consisting essentially of 40 to 70% by weight of cobalt, 20 to 40% by weight of iron, and 10 to 20% by weight of nickel. Of these prior art alloy films, the cobalt-iron-nickel film prepared according to Japanese Patent No. 2,821,456 is a very good magnetic head material because of a saturation magnetic flux density as high as 1.9 to 2.1 T, a low coercivity and a low magnetostriction constant. This cobalt-iron-nickel film has an electric resistivity of about $20\times10^{-6}$ Ω-cm, which is approximate to that of Permalloy.

For a writing head whose film thickness is reduced to about 3 μm in order to ensure a sufficient writing ability, the electric resistivity of the film must be increased and the eddy current loss at high frequencies be reduced before writing at a frequency in excess of 100 MHz becomes possible.

SUMMARY OF THE INVENTION

The invention is made to overcome the above-mentioned problem and its object is to provide a soft magnetic thin film having an electric resistivity of at least $50\times10^{-6}$ Ω-cm, a low coercivity, a low magnetostriction constant, and a saturation magnetic flux density of at least 1.6 T, and especially at least 1.7 T. Another object is to provide a method for preparing the soft magnetic thin film.

The inventor has found that by adding 0.02 to 0.1% by weight of carbon to a magnetic thin film having a cobalt content of 40 to 70% by weight, an iron content of 20 to 40% by weight, and a nickel content of 5 to 20% by weight, there is obtained a magnetic thin film having a high saturation magnetic flux density, excellent soft magnetic properties, and a high electric resistivity. Such a magnetic thin film can be readily prepared by effecting electroplating in a plating bath for magnetic thin film deposition containing a water-soluble cobalt salt, a water-soluble iron (II) salt, and a water-soluble nickel salt, to which an organic additive having an amino group within the molecule, typically diethylenetriamine (DTA) or alanine, is added. Then carbon is incorporated in the Co-Fe-Ni alloy film being electroplated. Better properties are obtained when the sulfur content of the magnetic thin film is controlled to 0.1% by weight or lower. Such a magnetic thin film is obtained from the above-mentioned plating bath containing the metal salts and amino-bearing organic additive wherein the ingredients other than a surfactant are free of sulfur element. Further the thin film is improved in corrosion resistance by heat treating the film at a temperature of 100 to 300° C.

According to a first aspect of the invention, there is provided a soft magnetic thin film in the form of a cobalt-iron-nickel-carbon thin film consisting essentially of 40 to 70% by weight of cobalt, 20 to 40% by weight of iron, 5 to 20% by weight of nickel, and 0.02 to 0.1% by weight of carbon. Preferably, the cobalt-iron-nickel-carbon thin film has a sulfur content of up to 0.1% by weight.

According to a second aspect, the soft magnetic thin film defined above is prepared by effecting electroplating in a plating bath containing a water-soluble cobalt salt, a water-soluble iron (II) salt, a water-soluble nickel salt, and an organic additive having an amino group within the molecule.

In the embodiment wherein the cobalt-iron-nickel-carbon thin film has a controlled sulfur content of up to 0.1% by weight, it is prepared by effecting electroplating at a cathodic current density of 3 to 25 mA/cm$^2$ in a plating bath containing a water-soluble cobalt salt, a water-soluble iron (II) salt, a water-soluble nickel salt, an organic additive, and a surfactant. The organic additive is diethylenetriamine, α-alanine, β-alanine, sodium glutamate, glycine or another organic compound having an amino group within the molecule. The ingredients other than the surfactant are free of sulfur element.

Preferably the electroplated cobalt-iron-nickel-carbon thin film is heat treated at a temperature of 100 to 300° C.

The method of the invention is successful in producing a magnetic thin film having a cobalt content of 40 to 70% by weight, an iron content of 20 to 40% by weight, a nickel content of 5 to 20% by weight, and a carbon content of 0.02 to 0.1% by weight. The resulting magnetic thin film has a saturation magnetic flux density as high as 1.6 to 2.1 tesla (T), excellent soft magnetic properties as demonstrated by a coercivity of up to 4 oersted (Oe), especially up to 3 Oe, and an electric resistivity of at least $50\times10^{-6}$ Ω-cm and even about $100\times10^{-6}$ Ω-cm at maximum. The soft magnetic thin film is used as the magnetic core to construct a magnetic head which develops a magnetic field of higher strength and sharper gradient than prior art magnetic heads and enables writing at a high frequency. There is obtained a magnetic storage unit capable of high speed and high density recording.

DESCRIPTION OF THE PREFERRED EMBODIMENTS

Figure 1:
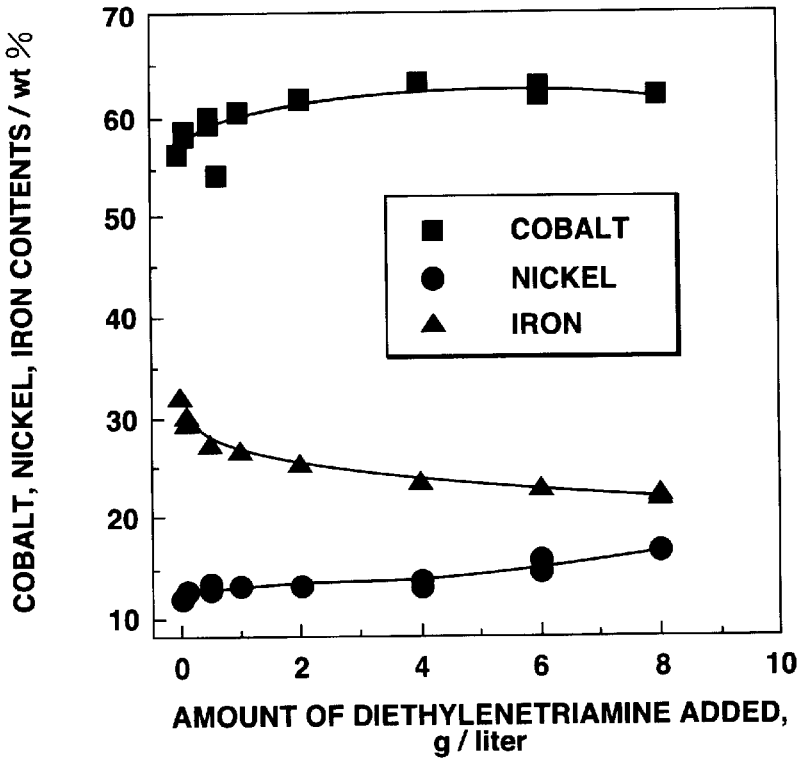
FIG. 1 is a graph showing the cobalt, iron and nickel contents of cobalt-iron-nickel-carbon thin films relative to the amount of diethylenetriamine in a plating solution.

The magnetic thin film of the invention is in the form of a cobalt-iron-nickel-carbon thin film consisting essentially of 40 to 70% by weight of cobalt, 20 to 40% by weight of iron, 5 to 20% by weight of nickel, and 0.02 to 0.1% by weight of carbon. The magnetic thin film preferably has a sulfur content of up to 0.3% by weight and especially up to 0.1% by weight. Within this compositional range, the objects of the invention are advantageously attained.

The magnetic thin film can be prepared by an electroplating process. The electroplating bath used herein is a Co—Fe—Ni alloy plating bath containing a water-soluble cobalt salt such as cobalt sulfate, a water-soluble iron (II) salt such as iron (II) sulfate, and a water-soluble nickel salt such as nickel sulfate, to which is added an organic compound having an amino group within the molecule. The composition of the Co—Fe—Ni alloy plating bath may be a well-known bath composition. The concentrations of the water-soluble cobalt salt, iron (II) salt, and nickel salt are properly determined so that the thin film deposited therefrom may have cobalt, iron and nickel contents within the above-defined range. As a general rule, the plating bath has a cobalt salt concentration of 0.005 to 0.007 mol/liter, an iron (II) salt concentration of 0.005 to 0.02 mol/liter, and a nickel salt concentration of 0.1 to 0.3 mol/liter.

To the plating bath is added an organic additive in the form of a water-soluble organic compound having an amino group within the molecule. Exemplary organic compounds are diethylenetriamine, α-alanine, β-alanine, glutamic acid and water-soluble salts thereof such as sodium glutamate, and glycine, though not limited thereto. It is preferred that the organic compound having an amino group within the molecule be free of sulfur element.

The organic compound having an amino group within the molecule serves as a carbon source when the magnetic thin film is deposited. The organic compound is added to the plating bath in a sufficient amount to provide a desired carbon content to the thin film. As a general rule, the plating bath contains the amino-bearing organic compound in a concentration of 0.005 to 0.18 mol/liter, and especially 0.01 to 0.1 mol/liter.

To the plating bath used herein, there may be added a conductive salt such as ammonium chloride, a surfactant such as sodium dodecylsulfate, a pH buffer agent such as boric acid, and other well-known additives in conventional amounts as employed in prior art baths. It is recommended to exclude sulfurous additives, for example, sulfurous stress-reducing agents such as sodium saccharin. In the preferred plating bath, the ingredients other than the surfactant are free of sulfur element.

Generally speaking, cobalt-iron-nickel ternary alloy compositions with a less nickel content will have a greater saturation magnetic flux density since nickel contributes to magnetic moment to a less extent than iron and cobalt. As a consequence, those cobalt-iron-nickel ternary alloy films which are deposited from a plating bath free of a sulfurous stress-reducing agent such as sodium saccharin and which fall in the compositional range providing satisfactory soft magnetic properties have a greater saturation magnetic flux density than those cobalt-iron-nickel ternary alloy films which are deposited from a plating bath containing sodium saccharin as a sulfurous stress-reducing agent and which fall in the compositional range providing satisfactory soft magnetic properties.

The plating bath used herein is acidic. The pH of the bath may be selected as appropriate although the bath is usually at pH 1.5 to 3.0.

In depositing a cobalt-iron-nickel-carbon thin film or magnetic thin film from the above-described plating bath, any conventional electroplating process may be employed. Preferably electroplating is effected at a temperature of 15 to 40° C. and a cathodic current density of 3 to 25 $mA/cm^2$. The bath may be stirred by any appropriate technique such as paddle stirring.

The cobalt-iron-nickel-carbon thin film thus deposited may be heat treated at a temperature of about 100 to 300° C., and especially about 200 to 250° C., for thereby improving corrosion resistance. The heat treatment is preferably carried out for a time of about ½ to 2 hours while the treating atmosphere may be air or inert gas such as nitrogen or vacuum.

The soft magnetic thin film of the invention is effectively used as the pole material for combined magnetic heads in magnetic storage units. The combined magnetic head may be of well-known construction wherein the magnetic layers consist of magnetic thin films according to the invention. The thickness of the thin film may be determined as appropriate although it is usually in the range of 0.1 to 4.0 μm.

EXAMPLE

Examples of the invention are given below by way of illustration and not by way of limitation. In the following examples, thin films were plated on copper foil, NiFe, titanium and glass plates while a platinum wire was used as the anode. The plated thin films were 1 μm thick.

Example 1

Cobalt-iron-nickel-carbon thin films were deposited from plating baths using diethylenetriamine as an additive. The composition of the plating bath and the plating conditions are shown below.

(A) Plating Bath Composition Free of a Stress-reducing Additive and Plating Conditions

| | Concentration |
|---|---|
| Bath composition | |
| Cobalt sulfate | 0.06–0.07 mol/liter |
| Nickel sulfate | 0.20 mol/liter |
| Iron (II) sulfate | 0.006 to 0.035 mol/liter |
| Boric acid | 0.4 mol/liter |
| Ammonium chloride | 0.28 mol/liter |
| Diethylenetriamine | as shown in FIGS. 1 to 5 |
| Sodium dodecylsulfate | 0.01 g/liter |
| Plating conditions | |
| Bath temperature | 20–30° C. |
| Cathodic current density | 10 mA/cm$^2$ |
| pH | 2.8 |
| Stirring | paddle stirring |

The cobalt-iron-nickel-carbon thin films deposited from diethylenetriamine-containing plating baths under condition (A) were analyzed, with the results being shown in the graphs.

FIG. 1 graphically shows the cobalt, iron and nickel contents of the thin films relative to the amount of diethylenetriamine added to the plating solution. As the amount of diethylenetriamine in the plating solution is increased from 0 g/liter to 8 g/liter, the cobalt content of the plated film increases from 56% to 60% by weight and the iron content decreases from 32% to 24% by weight.

Figure 2:
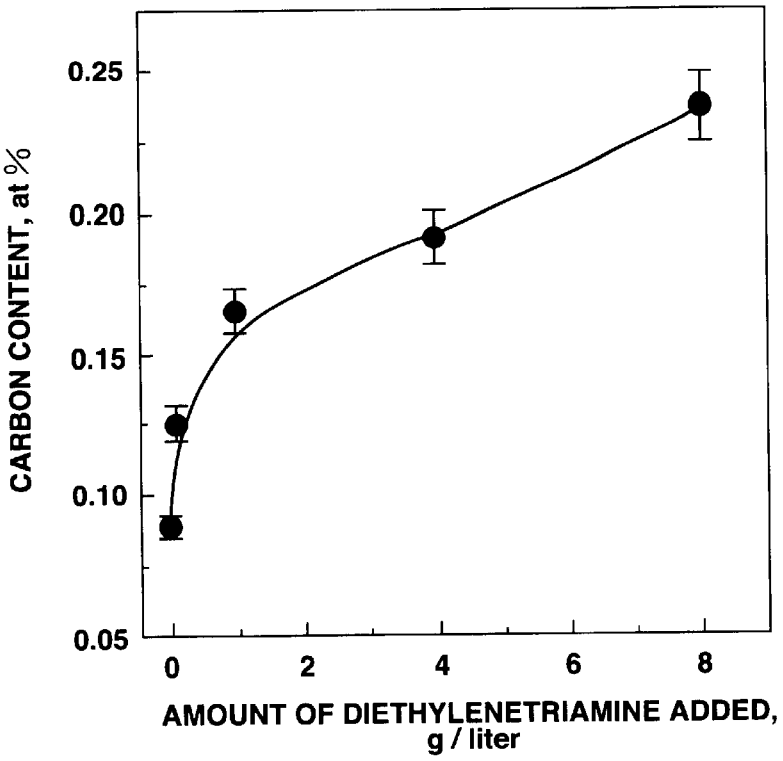
FIG. 2 is a graph showing the carbon content of cobalt-iron-nickel-carbon thin films relative to the amount of diethylenetriamine in a plating solution.

FIG. 2 graphically shows the carbon content of cobalt-iron-nickel-carbon thin films relative to the amount of diethylenetriamine in the plating solution when the films were set at an elemental ratio of cobalt:nickel:iron of 55–57:12–13:30–31. The carbon content exceeds 0.04% by weight (0.17 at%) when the amount of diethylenetriamine exceeds 1 g/liter.

Figure 3:
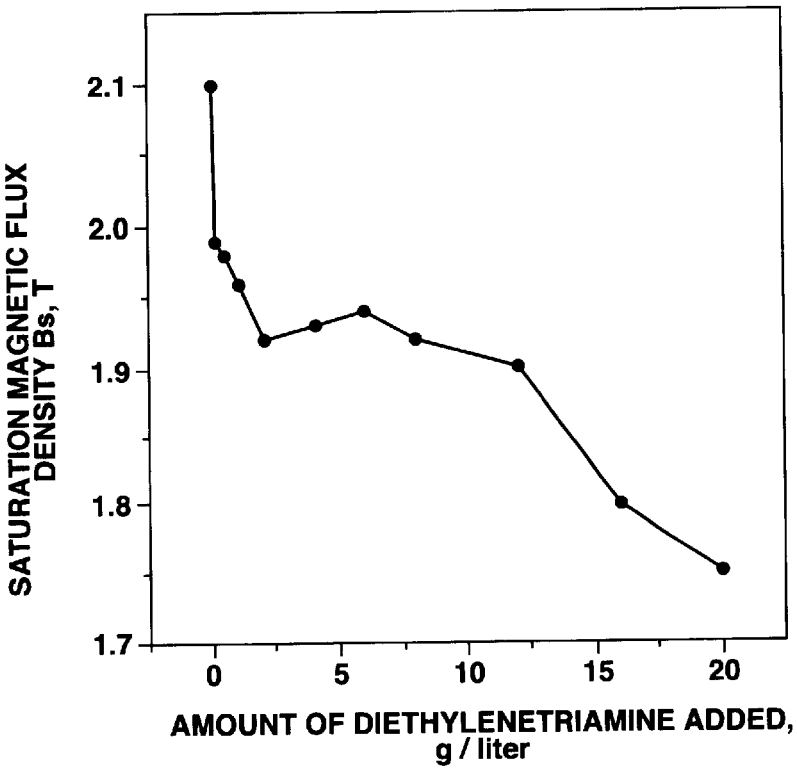
FIG. 3 is a graph showing the saturation magnetic flux density (Bs) of cobalt-iron-nickel-carbon thin films relative to the amount of diethylenetriamine in a plating solution.

FIG. 3 graphically shows the saturation magnetic flux density (Bs) of cobalt-iron-nickel-carbon thin films relative to the amount of diethylenetriamine added to the plating solution. No definite relationship is found between the saturation magnetic flux density and the addition amount until the amount of diethylenetriamine reaches 13 g/liter, but all these plated films exhibit a high saturation magnetic flux density of at least 1.9 T.

Figure 4:
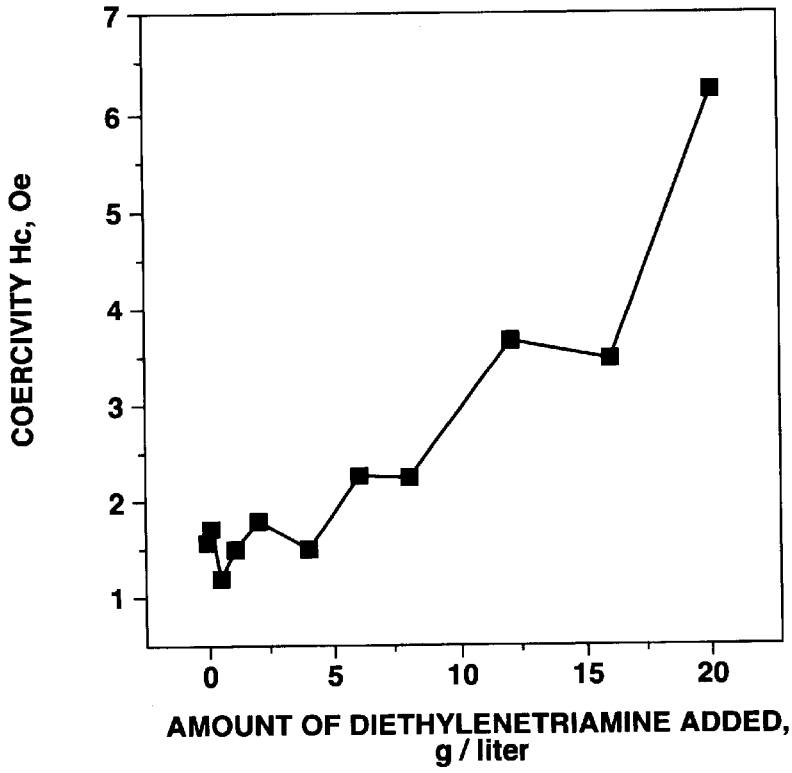
FIG. 4 is a graph showing the coercivity (Hc) of cobalt-iron-nickel-carbon thin films relative to the amount of diethylenetriamine in a plating solution.

FIG. 4 is a graph showing the coercivity (Hc) of cobalt-iron-nickel-carbon thin films relative to the amount of diethylenetriamine added to the plating solution. No definite relationship is found between the coercivity and the addition amount until the amount of diethylenetriamine reaches 4 g/liter, and all these plated films exhibit a low coercivity of less than 2 Oe. The additional plated films exhibit a coercivity of less than 5 Oe until the amount of diethylenetriamine reaches 17 g/liter.

Figure 5:
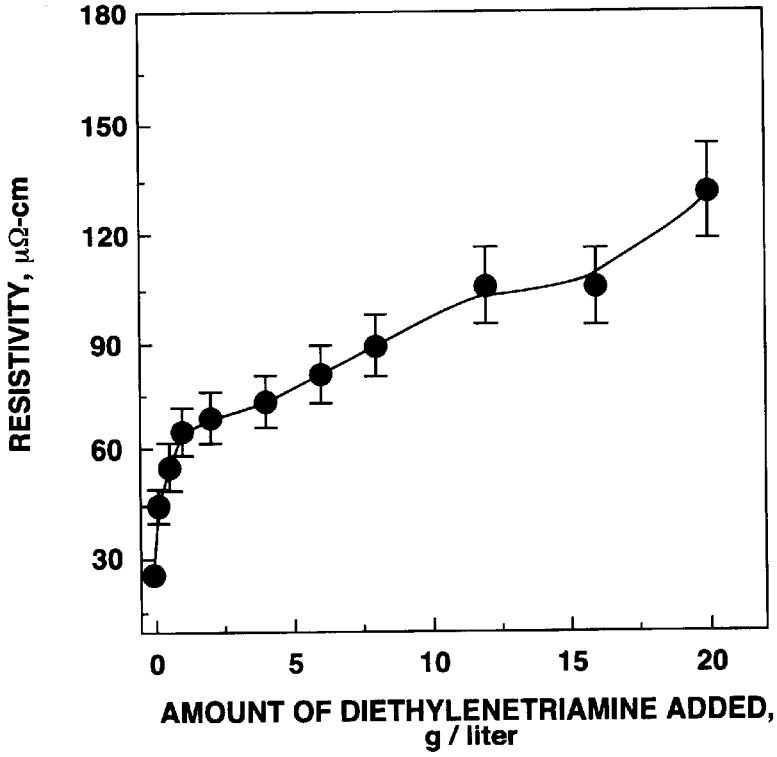
FIG. 5 is a graph showing the electric resistivity of cobalt-iron-nickel-carbon thin films relative to the amount of diethylenetriamine in a plating solution.

FIG. 5 is a graph showing the electric resistivity of cobalt-iron-nickel-carbon thin films relative to the amount of diethylenetriamine added to the plating solution. The plated films exhibit a resistivity of $70\times10^{-6}$ Ω-cm when diethylenetriamine is added to 2 g/liter, and a resistivity of $100\times10^{-6}$ Ω-cm is reached when diethylenetriamine is added to 12 g/liter.

It is seen that by adding diethylenetriamine to the plating bath under condition (A), the electric resistivity of plated films can be increased while maintaining a high saturation magnetic flux density and excellent soft magnetic properties.

Example 2

Cobalt-iron-nickel-carbon thin films were deposited from plating baths using β-alanine as an additive. The composition of the plating bath and the plating conditions are shown below.

(B) Plating Bath Composition Free of a Stress-reducing Additive and Plating Conditions

| | Concentration |
|---|---|
| Bath composition | |
| Cobalt sulfate | 0.06 mol/liter |
| Nickel sulfate | 0.20 mol/liter |
| Iron (II) sulfate | 0.015 mol/liter |
| Boric acid | 0.4 mol/liter |
| Ammonium chloride | 0.28 mol/liter |
| β-alanine | 0.01–0.1 mol/liter |
| Sodium dodecylsulfate | 0.01 g/liter |
| Plating conditions | |
| Bath temperature | 20–30° C. |
| Cathodic current density | 20 mA/cm$^2$ |
| pH | 2.8 |
| Stirring | paddle stirring |

The cobalt-iron-nickel-carbon thin films deposited from β-alanine-containing plating baths under condition (B) were analyzed, with the results being shown in the graphs.

Figure 6:
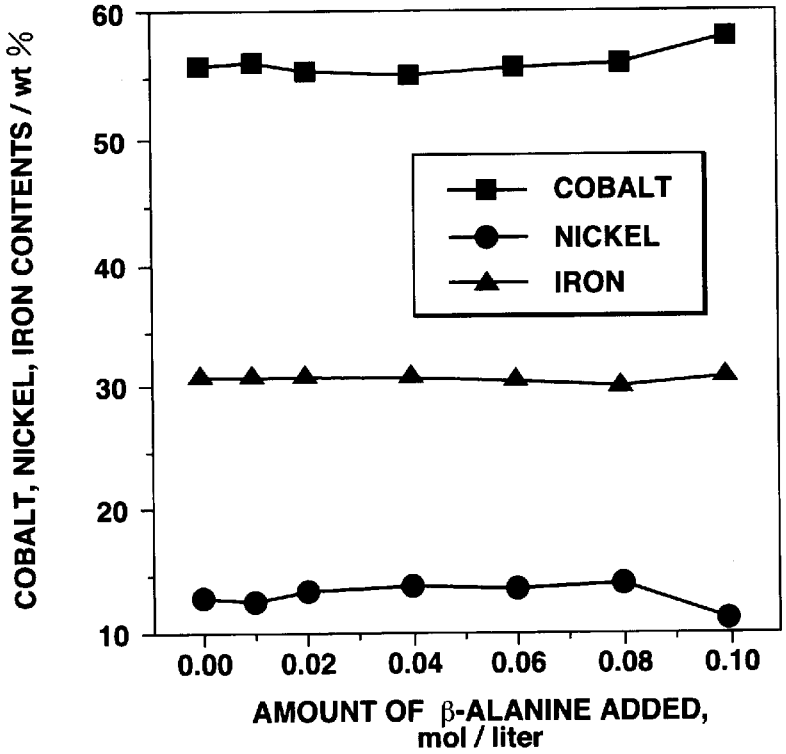
FIG. 6 is a graph showing the cobalt, iron and nickel contents of cobalt-iron-nickel-carbon thin films relative to the amount of β-alanine in a plating solution.

FIG. 6 graphically shows the cobalt, iron and nickel contents of the thin films relative to the amount of β-alanine added to the plating solution. The cobalt, iron and nickel contents remain substantially unchanged when the amount of β-alanine in the plating solution is increased from 0 mol/liter to 0.08 mol/liter. When β-alanine is added to 0.10 mol/liter, the cobalt content of the plated film increases from 56% to 58% by weight and the nickel content accordingly changed from 13% to 11% by weight.

Figure 7:
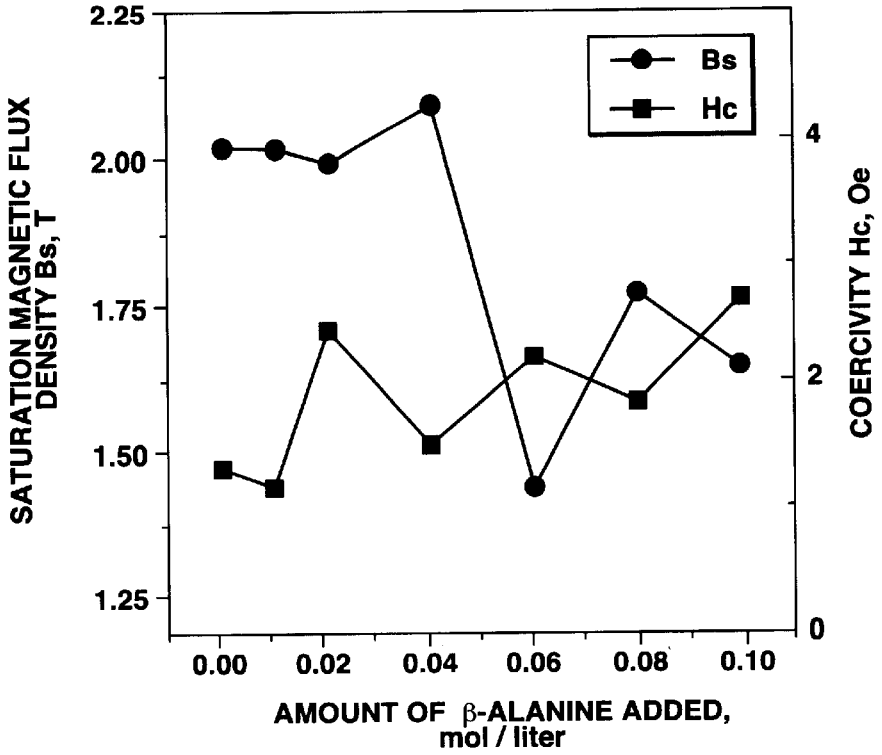
FIG. 7 is a graph showing the saturation magnetic flux density (Bs) and coercivity (Hc) of cobalt-iron-nickel-carbon thin films relative to the amount of β-alanine in a plating solution.

FIG. 7 graphically shows the saturation magnetic flux density (Bs) and coercivity (Hc) of cobalt-iron-nickel-carbon thin films relative to the amount of β-alanine added to the plating solution. The saturation magnetic flux density (Bs) remains above 2.0 T until the amount of β-alanine reaches 0.04 mol/liter, but declines with larger amounts of β-alanine. The coercivity is about 2.0 Oe or lower until the amount of β-alanine reaches 0.1 mol/liter. It is seen that every plated film exhibits satisfactory soft magnetic properties until the amount of β-alanine reaches about 0.1 mol/liter. The plated film had a carbon content of 0.15 at% when 0.06 mol/liter of β-alanine was added.

Figure 8:
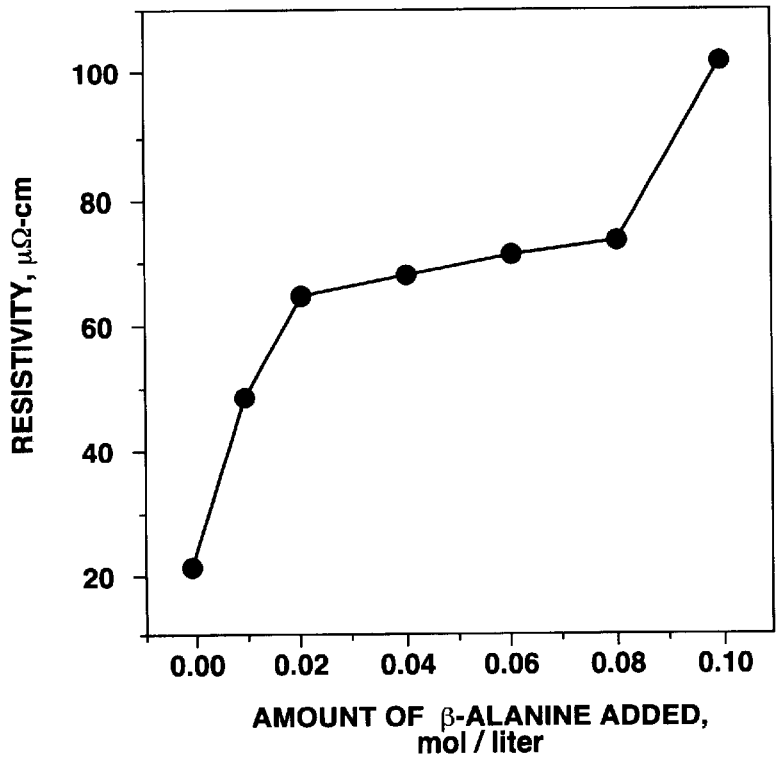
FIG. 8 is a graph showing the electric resistivity of cobalt-iron-nickel-carbon thin films relative to the amount of β-alanine in a plating solution.

FIG. 8 is a graph showing the electric resistivity of cobalt-iron-nickel-carbon thin films relative to the amount of β-alanine added to the plating solution. The resistivity increases linearly until the amount of β-alanine reaches 0.02 mol/liter. No substantial change of resistivity occurs while the amount of β-alanine increases from 0.02 mol/liter to 0.08 mol/liter. When the amount of β-alanine is increased to 0.1 mol/liter, a resistivity rise occurs again, marking about $100\times10^{-6}$ Ω-cm.

It is seen that by adding β-alanine to the plating bath under condition (B), the electric resistivity of plated films can be increased while maintaining a high saturation magnetic flux density and excellent soft magnetic properties.

Example 3

Cobalt-iron-nickel-carbon thin films were deposited from plating baths using sodium L-glutamate as an additive. The composition of the plating bath and the plating conditions are shown below.

| | Concentration |
|---|---|
| Bath composition | |
| Cobalt sulfate | 0.06–0.075 mol/liter |
| Nickel sulfate | 0.2 mol/liter |
| Iron (II) sulfate | 0.006–0.045 mol/liter |
| Boric acid | 0.4 mol/liter |
| Ammonium chloride | 0.28 mol/liter |
| Sodium L-glutamate | 0–0.01 mol/liter |
| Sodium dodecylsulfate | 0.01 g/liter |
| Plating conditions | |
| Bath temperature | room temperature |
| Cathodic current density | 5–30 mA/cm$^2$ |
| pH | 1.8–2.8 |
| Stirring | 1,000 rpm |

Figure 9:
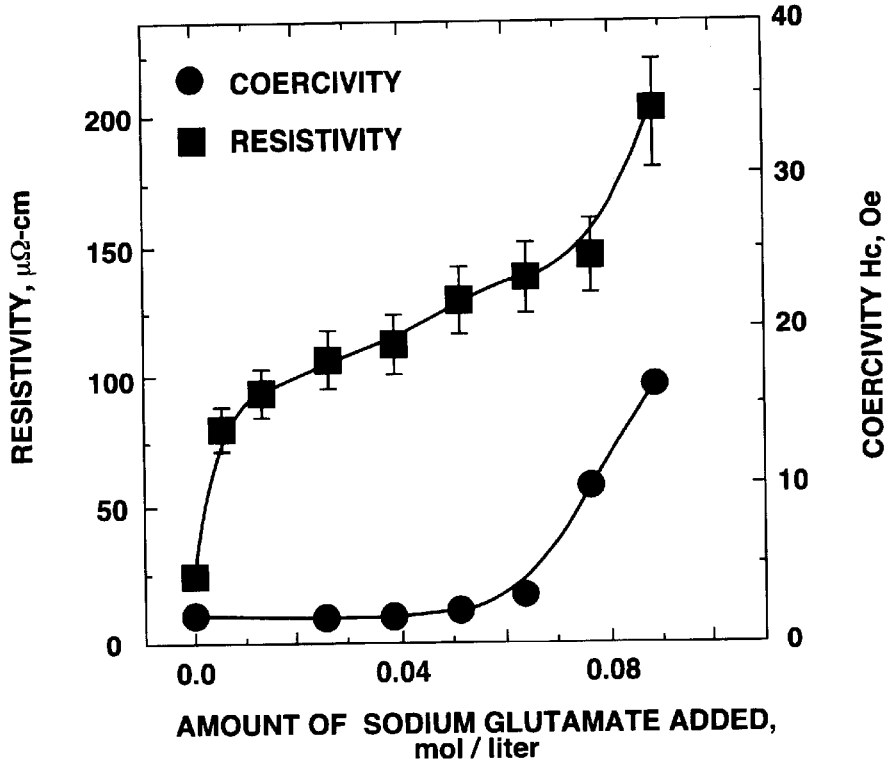
FIG. 9 is a graph showing the electric resistivity and coercivity (Hc) of cobalt-iron-nickel-carbon thin films relative to the amount of sodium glutamate in a plating solution.

The properties of the plated films are shown in Table 1 and FIG. 9.

TABLE 1

| Sodium L-glutamate concentration (mol/liter) | Hc (Oe) | Resistivity (μΩ-cm) |
|---|---|---|
| 0.0025 | 1.7 | 78 |
| 0.00375 | 1.8 | 90 |
| 0.005 | 2.1 | 100 |
| 0.00625 | 3.1 | 109 |

It is seen that by adding sodium L-glutamate, for example, in a concentration of 0.005 mol/liter, a thin film having a coercivity of 2.1 Oe and a resistivity of $100\times10^{6}$ Ω-cm is obtained.

As is evident from the above results, the cobalt-iron-nickel-carbon thin films deposited by the method of the invention satisfy a high magnetic flux density, excellent soft magnetic properties, and a high electric resistivity.

Example 4

A cobalt-iron-nickel-carbon thin film represented by $(Co_{56}Ni_{13}Fe_{31})_{99.76}C_{0.24}$ was deposited as in Example 1 wherein the salts were adjusted so as to give a ratio of cobalt:nickel:iron of 56:13:14 and the amount of diethylenetriamine added was 8 g/liter.

The thin film was heat treated under the following conditions.

| | |
|---|---|
| Heat treating temperature | 250° C. |
| Heat treating time | 1 hour |
| Heating rate | 10° C./min |
| Cooling rate | air cooling |

The thin film as heat treated had the following properties.

| | |
|---|---|
| Magnetic properties | Bs = 1.9 T |
| | Hc < 2.5 Oe |
| Electric properties | resistivity = 90 μΩ-cm |

Before and after the heat treatment, the thin film was examined for corrosion resistance by an anodic polarization technique. Corrosion resistance was measured under the following conditions.

| | |
|---|---|
| Solution | 2.5 wt % NaCl aqueous solution |
| Sweeping rate | 10 mV/sec |
| Sweeping range | −1.0 to +0.5 V |
| Reference electrode | Ag/AgCl |

Figure 10:
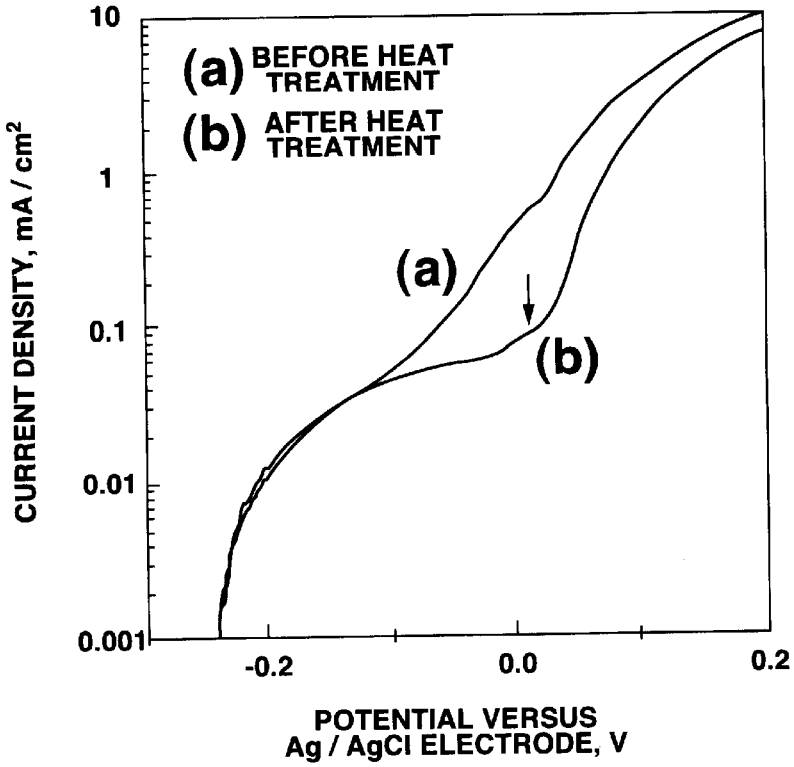
FIG. 10 is a graph showing the results of a corrosion resistance test by anodic polarization on a cobalt-iron-nickel-carbon thin film before and after heat treatment.

The results are shown in FIG. 10 where (a) is a polarization curve of the thin film before heat treatment, and (b) is a polarization curve of the heat treated thin film. When the thin film is polarized on the anodic side in a 2.5 wt % NaCl aqueous solution, the untreated thin film becomes dissolvable on the anodic side as seen from curve (a). The heat treated thin film has a passive region as seen from curve (b) where a point indicating the pitting corrosion potential, as given by an arrow, appears, ascertaining an improvement in corrosion resistance.

There have been described soft magnetic thin films having a high saturation magnetic flux density, excellent soft magnetic properties, and a high electric resistivity. The method of the invention ensures that soft magnetic thin films having such improved properties are formed.

Japanese Patent Application Nos. 11-10413 and 11-204023 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A method for preparing a soft magnetic thin film in the form of a cobalt-iron-nickel-carbon thin film consisting essentially of 40 to 70% by weight of cobalt, 20 to 40% by weight of iron, 5 to 20% by weight of nickel, and 0.02 to 0.1% by weight of carbon, and having a sulfur content up to 0.1% by weight, said method comprising the step of effecting electroplating in a plating bath containing a water-soluble cobalt salt, a water-soluble iron (II) salt, a water-soluble nickel salt, and an organic additive having an amino group within the molecule, which is at least one selected from the group consisting of diethylenetriamine, α-alanine, β-alanine, glycine, glutamic acid and water-soluble salts thereof and being free of sulfur element, said plating bath being acidic.

2. The method of claim 1 further comprising heat treating the electroplated cobalt-iron-nickel-carbon thin film at a temperature of 100 to 300° C.

3. The method of claim 1, wherein the plating bath has a pH of 1.5 to 3.0.

4. The method of claim 1, wherein the plating bath contains the organic additive having an amino group within the molecule in a concentration of 0.005 to 0.18 mol/liter.

5. The method of claim 1, wherein the plating bath contains the organic additive having an amino group within the molecule in a concentration of 0.01 to 0.1 mol/liter.

6. A method for preparing a soft magnetic thin film in the form of a cobalt-iron-nickel-carbon thin film consisting essentially of 40 to 70% by weight of cobalt, 20 to 40% by weight of iron, 5 to 20% by weight of nickel, and 0.02 to 0.1% by weight of carbon, and having a sulfur content of up to 0.1% by weight, said method comprising the step of effecting electroplating at a cathodic current density of 3 to 25 $mA/cm^2$ in a plating bath containing a water-soluble cobalt salt, a water-soluble iron (II) salt, a water-soluble nickel salt, an organic additive which is at least one selected from the group consisting of diethylenetriamine, α-alanine, β-alanine, sodium glutamate, and glycine, and a surfactant, the ingredients other than the surfactant being free of sulfur element, said plating bath being acidic.

7. The method of claim 6 further comprising heat treating the electroplated cobalt-iron-nickel-carbon thin film at a temperature of 100 to 300° C.

8. The method of claim 6, wherein the plating bath contains the organic additive having an amino group within the molecule in a concentration of 0.005 to 0.18 mol/liter.

9. The method of claim 6, wherein the plating bath has a pH of 1.5 to 3.0.

10. The method of claim 6, wherein the plating bath contains the organic additive having an amino group within the molecule in a concentration of 0.01 to 0.1 mol/liter.

* * * * *